US008022886B2

(12) United States Patent
Kai et al.

(10) Patent No.: US 8,022,886 B2
(45) Date of Patent: Sep. 20, 2011

(54) CROSSED DUAL TAG APPARATUS AND SYSTEM USING CROSSED DUAL TAG APPARATUS

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 271 days.

(21) Appl. No.: 12/081,344

(22) Filed: Apr. 15, 2008

(65) Prior Publication Data

US 2008/0291106 A1 Nov. 27, 2008

(30) Foreign Application Priority Data

May 9, 2007 (JP) ..... 2007-125055

(51) Int. Cl.
*H01Q 21/26* (2006.01)

(52) U.S. Cl. ..... 343/797; 343/793; 343/798; 343/842

(58) Field of Classification Search ..... None
See application file for complete search history.

(56) References Cited

U.S. PATENT DOCUMENTS

| | | | | |
|---|---|---|---|---|
| 6,173,900 | B1 | 1/2001 | Yoshigi et al. | |
| 6,720,930 | B2 * | 4/2004 | Johnson et al. | 343/742 |
| 7,068,223 | B2 * | 6/2006 | Yoshida et al. | 343/700 MS |
| 7,538,738 | B2 | 5/2009 | Kai et al. | |
| 2002/0109636 | A1 | 8/2002 | Johnson et al. | 343/742 |
| 2004/0061660 | A1 * | 4/2004 | Yoshida et al. | 343/788 |
| 2005/0040994 | A1 | 2/2005 | Mazoki et al. | 343/809 |
| 2006/0107307 | A1 | 5/2006 | Knox et al. | |
| 2006/0208900 | A1 | 9/2006 | Hozouri | 340/572.7 |
| 2006/0208955 | A1 * | 9/2006 | Kai et al. | 343/795 |
| 2006/0267843 | A1 | 11/2006 | Sakama et al. | |
| 2007/0268194 | A1 * | 11/2007 | Kai et al. | 343/793 |
| 2007/0273526 | A1 | 11/2007 | Fukasawa et al. | |
| 2009/0096701 | A1 * | 4/2009 | Kai et al. | 343/803 |

FOREIGN PATENT DOCUMENTS

| | | |
|---|---|---|
| EP | EP 1 370 007 | 12/2003 |
| EP | EP 1 703 589 | 9/2006 |
| JP | 2003-249820 | 9/2003 |
| JP | 2006-113869 A | 4/2006 |
| JP | 2006-333403 A | 12/2006 |

OTHER PUBLICATIONS

Chinese Office Action dated Nov. 20, 2009 of corresponding Chinese Patent Application No. 200810096423.2.

European Search Report dated May 26, 2009 of corresponding European Patent Application No. 08103626.1.

(Continued)

*Primary Examiner* — Trinh V Dinh

(74) *Attorney, Agent, or Firm* — Fujitsu Patent Center

(57) ABSTRACT

A crossed dual tag includes two tags each of which comprises, on one plane, a dipole antenna formed with conductors, a feeding part to which an IC chip is connected at the center of the dipole antenna, and a loop-shaped inductance part that is formed between the dipoles of the dipole antenna and connected to the dipoles of the dipole antenna in parallel with respect to the feeding part. The two tags are crossed at right angles, and stacked to contact as closely as possible so that the loops of the inductance parts overlap as wide as possible. A reader/writer of an RFID system sequentially switches the surface of a circular polarized wave of a wireless signal between forward and backward directions, and reads information written to a user memory area from the tag that responds more strongly.

17 Claims, 11 Drawing Sheets

OTHER PUBLICATIONS

Official communication dated Feb. 23, 2010 for the corresponding Korean patent application 10-2008-0042351.

Japan Patent Office; Official Action (Notice of Rejection) mailed in connection with JP 2007-125055, Apr. 19, 2011. English-language translation provided.

Japan Patent Office; Patent Abstracts of Japan, Publication No. 2002-280829 (Publication Date Sep. 27, 2002); http://www19.ipdl.inpit.go.jp/PA1.

Japan Patent Office; Patent Abstracts of Japan, Publication No. 2003-249871 (Publication Date Sep. 5, 2003); http://www19.ipdl.inpit.go.jp/PA1.

Japan Patent Office; Patent Abstracts of Japan, Publication No. 2004-172906 (Publication Date Jun. 17, 2004); http://www19.ipdl.inpit.go.jp/PA1.

Japan Patent Office; Patent Abstracts of Japan, Publication No. 2006-285594 (Publication Date Oct. 19, 2006); http://www19.ipdl.inpit.go.jp/PA1.

Japan Patent Office; Patent Abstracts of Japan, Publication No. H08-065225 (Publication Date Mar. 8, 1996); http://www19.ipdl.inpit.go.jp/PA1.

* cited by examiner

CROSSED DUAL TAG APPARATUS AND SYSTEM USING CROSSED DUAL TAG APPARATUS

RELATIVE APPLICATIONS

This application claims the benefit of Japanese Application No. 2007-125055, filed on May 9, 2007, the disclosures of which Application is incorporated by reference herein.

BACKGROUND OF THE INVENTION

1. Field of the Invention

The present invention relates to a crossed dual tag the communication distance of which with a reader/writer is extended by crossing two linear polarized wave tags at right angles, and to an RFID (Radio Frequency IDentification) system using the crossed dual tag.

2. Description of the Related Art

Conventionally, RFID systems are put into practical use as a non-contact authentication technology for recording various items of information about a person or an object in an IC (Integrated Circuit) chip of an RFID, and for wirelessly reading the information with a reader/writer.

The RFID is generally referred to as wireless tag or merely as tag although it is called in a variety of ways.

A tag is composed of a metal antenna formed on a plane of a sheet, a film, etc. with a thickness of approximately 0.1 mm, and an IC chip connected to the feeding point of the antenna.

Normally, an IC chip is extremely small, and its thickness and area size are on the order of 0.2 mm and a 1-mm-square respectively. An antenna connected to the IC chip is formed as a dipole antenna pattern, and its communication wave generated by a resonant current is a linear polarized wave.

In an RFID system, a reader/writer transmits a signal of a wireless radio wave of approximately 1 W, the side of a tag receives the signal and returns information within the IC chip as a response signal to the side of the reader/writer, and the reader/writer reads the information.

The tag does not include a battery. When the tag makes an approach to the reader/writer, an electric current is generated by the resonation of the antenna of the tag with the radio wave emitted by the reader/writer. Only at this moment, the circuit of the IC chip operates to transmit the information therein to the reader/writer.

The antenna on the side of the reader/writer is formed to emit a circular polarized radio wave for enabling a communication with the tag generating a linear polarized wave for its communication regardless of any direction of the orientation of the tag.

UHF (Ultra High Frequency) ranging from 860 to 960 MHz is applied as the radio wave used for this transmission. For example, UHF of 952 to 954 MHz is used in Japan.

A communication distance between the reader/writer and the tag is approximately 3 to 5 m under an ideal condition although it depends on the gain of the antenna of the tag, the operational voltage of the IC chip, an ambient environment, or the like.

The antenna of the reader/writer makes a communication by using a circular polarized radio wave, whereas the antenna of the tag makes a communication by using a linear polarized wave. Therefore, power produced by resonating with the radio wave received from the reader/writer, namely, the power received from the reader/writer is one half of that in the case where the tag is assumed to generate the circular polarized wave.

Transmission power is attenuated in inverse proportion to the square of a distance. Therefore, the above described actual communication distance 3 to 5 m is reduced to $1/\sqrt{2}=1/1.41$ of that in the case where also the tag generates a circular polarized wave.

As the tag intended to merely emit a circular polarized wave, a configuration where two dipole antennas are crossed at right angles, two feeding terminals for connecting one of the dipoles of one dipole antenna to one of the dipoles of the other dipole antenna and for connecting the other dipole of one dipole antenna to the other dipole of the other dipole antenna are provided, and an IC tag and a circuit having a phase difference of $\pi/2$ are connected between the two feeding terminals is proposed (for example, see Patent Document 1).

When the tag is implemented as the tag generating a circular polarized wave as described above, the two orthogonal dipole antennas using linear polarized waves must be connected with the circuit having the phase difference of n2, namely, a 90° phase shifter.

The tag normally has a simple structure implemented by directly connecting a dipole antenna pattern to a small IC with an area size of an approximately 1-mm-square. Therefore, the structure that requires a 90° phase shifter in addition to the IC as disclosed by Patent Document 1 leads to an undesirable increase in an overall cost.

Additionally, the technique disclosed by Patent Document 1 is the tag configured specifically for generating a circular polarized wave, in which the dipole antennas are crossed at right angles and prevented from being separated, and connected to the IC tag and the 90° phase shifter. This tag must be specifically designed and manufactured with dedicated process steps, leading to lack in the degree of arbitrariness of design.

[Patent Document 1] Japanese Published Unexamined Application No. 2003-249820

SUMMARY OF THE INVENTION

A crossed dual tag in a first aspect of the present invention is a tag configured by comprising first and second tags, each of which comprises, on one plane, a dipole antenna formed with conductors, a feeding part to which an IC chip is connected at the center of the dipole antenna, and a loop-shaped inductance part that is formed between the dipoles of the dipole antenna and connected to the dipoles of the dipole antenna in parallel with respect to the feeding part, and by crossing the first and the second tags so that the loops of the inductance part overlap.

In this crossed dual tag, the inductance part is formed in the shape of, for example, a square, a circle, or a loop similar to the square or the circle.

Additionally, the first and the second tags are crossed so that the loops of the inductance parts overlap as wide as possible, and stacked to contact as closely as possible. The first and the second tags generate a circular polarized wave, for example, at the crossing angle of 90°.

The crossed dual tag further comprises a holding member having a groove according to the crossed shape of the first and the second tags. The holding member holds the first and the second tags in the crossed shape with its groove.

An RFID (Radio Frequency IDentification) system in a second aspect of the present invention is a system including a crossed dual tag configured by comprising first and second tags, each of which comprises, on one plane, a dipole antenna formed with conductors, a feeding part to which an IC chip is connected at the center of the dipole antenna, and a loop-shaped inductance part that is formed between the dipoles of the dipole antenna and connected to the dipoles of the dipole antenna in parallel with respect to the feeding part, and by crossing the first and the second tags so that the loops of the inductance parts overlap, and a reader/writer that emits a wireless signal of a circular polarized wave in order to read information of the first or the second tag.

In this RFID system, for example, the first tag is set as a tag from which information is to be read, the second tag is set as a tag from which information is not to be read, and the reader/writer is configured to always reads only the information of the first tag.

Additionally, for example, the first and the second tags may respectively have user memory areas to which the same information is written, and the reader/writer may be configured to switch the surface of the circular polarized wave of the wireless signal between forward and backward directions, and to read the information written to the user memory area from the first or the second tag, which responds more strongly to the switched circular polarized wave.

Furthermore, for example, the first and the second tags may comprise user memory areas to which mutually different information are written, and the reader/writer may be configured to sequentially switch the surface of the circular polarized wave of the wireless signal between the forward and the backward directions, and to read the information written to the user memory areas from both the first and the second tags by reading the information written to the user memory area from the first or the second tag, which responds more strongly to the switched circular polarized wave.

As described above, according to the present invention, the two tags generating linear polarized waves are used unchanged as one crossed-dual tag by being crossed and stacked without requiring a special circuit, etc., and the crossed dual tag generates a circular polarized wave.

As a result, a tag which generates a circular polarized wave and the communication distance of which from a reader/writer is extended by 1.41 times the communication distance in the case of using one tag generating a linear polarized wave, and an RFID system using this tag can be provided at low cost.

DESCRIPTION OF THE PREFERRED EMBODIMENTS

Preferred embodiments according to the present invention are described below with reference to the drawings.

First Preferred Embodiment

Figure 1:
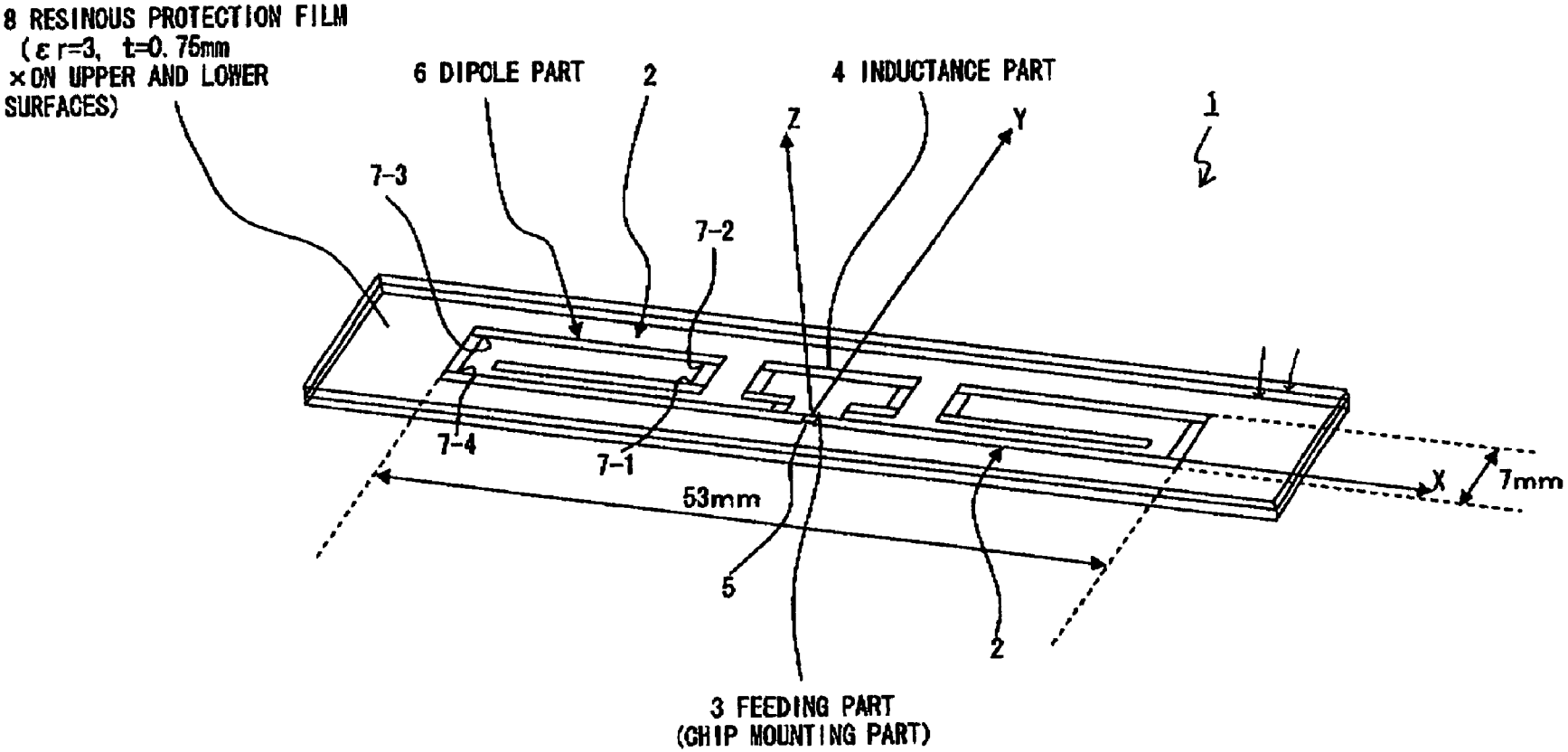
FIG. 1 is a perspective view showing a configuration of an antenna of an extremely small tag in a first preferred embodiment.

FIG. 1 is a perspective view showing a configuration of an extremely small tag and its antenna in the first preferred embodiment. The dimensions of the tag 1 shown in this figure are 53 mm wide by 7 mm deep.

The tag 1 comprises, on one plane, a dipole antenna 2 formed with conductors, a feeding part 3, and an inductance part 4. Preferably, Cu, Au, or Al is used as the above described conductors.

The feeding part 3 configures a chip mounting part at the center of the dipole antenna 2. In the chip mounting part, an IC chip 5 is mounted. 1-mm-wide dipole parts 6 are formed on both sides of the feeding part 3. The entire dipole antenna 2 is configured in this way.

The dipoles of the dipole antenna 2 composed of the dipole parts 6 arranged on both sides are respectively formed in the shape of a rectangular eddy by being inwardly bent at least at four bending parts (7-1, 7-2, 7-3, 7-4). Namely, the dipole parts 6 have the four bending parts respectively in this preferred embodiment.

The total length of the dipole antenna 2 when the four bending parts 7 are linearly stretched respectively is formed to become shorter than one half of the resonance wavelength of the antenna.

Additionally, the above described inductance part 4 is arranged between the dipole parts 6 and 6, which are formed in the shape of the rectangular eddy, in the vicinity of the center of the dipole antenna 2.

The inductance part 4 is connected to the dipole parts 6 and 6 in parallel with respect to the feeding part 3 of the dipole antenna 2, namely, the IC chip 5.

The IC chip 5 mounted in the feeding part 3 is, for example, a chip with Rc of 500Ω and Cc of 1.4 pF. The inductance part 4 is arranged on the side of the antenna, and cancels the capacitive component of 1.4 pF of the IC chip 5.

The above described inductance part 4 is formed in the shape of almost one rectangular loop in the embodiment shown in FIG. 1. The loop shape of the inductance part 4 is not limited to this one, and may be the shape of a square, a circle, or a shape similar to such loops.

Resinous protection films 8 with a permittivity $\epsilon r$ of 3 and a thickness t of 0.75 mm are respectively overlaid on both surfaces (the top and the bottom surfaces in FIG. 1) of the tag 1.

For example, a terephthalate ethylene film, etc. is used as the resinous protection films 8. Alternatively to the resinous protection films, suitable paper sheets may be overlaid on both of the surfaces of the tag 1.

Figure 2:
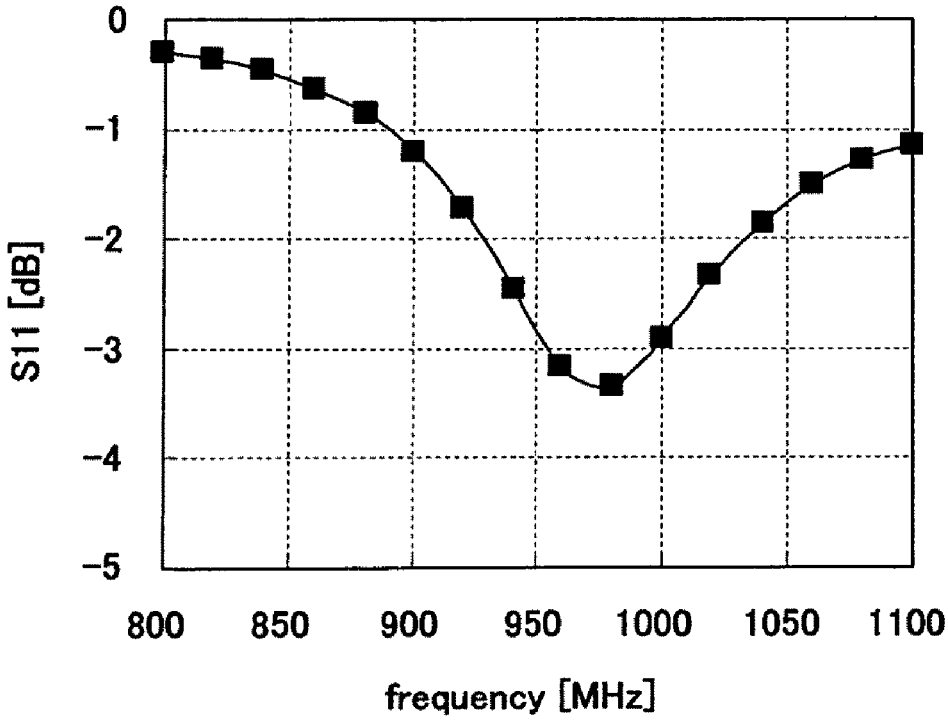
FIG. 2 is a chart representing the frequency characteristic of reflection of the tag antenna in the first preferred embodiment, which is calculated by an electromagnetic field simulator.

FIG. 2 is a chart representing the frequency characteristic of reflection of the dipole antenna 2 of the tag 1, which is calculated with an electromagnetic field simulator.

In this figure, the horizontal axis indicates the frequency (800 to 1100 MHz), whereas the vertical axis indicates the reflection (−5 to 0 dB). As is known from this figure, the reflection is the lowest in the vicinity of 975 MHz.

Figure 3:
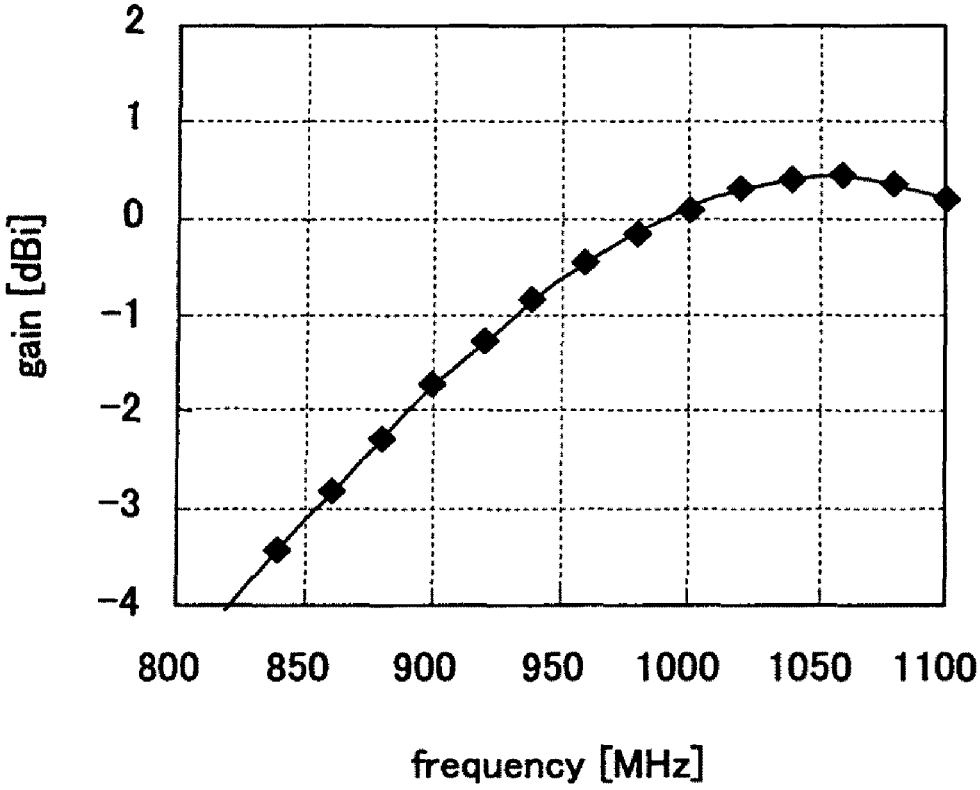
FIG. 3 is a chart representing the value of an antenna gain of the tag antenna in the first preferred embodiment, which is calculated by the electromagnetic field simulator.

FIG. 3 is a chart representing the value of the gain of the dipole antenna 2 of the tag 1, which is calculated with the above described electromagnetic field simulator.

In this figure, the horizontal axis indicates the frequency (800 to 1100 MHz), whereas the vertical axis indicates the antenna gain (−4 to 2 dBi). The antenna gain shown in this figure is the largest in the vicinity of 1050 MHz.

Namely, there is a disadvantage that the reflection is high in the vicinity of 1050 MHz. However, since the antenna gain is large in the vicinity of 1050 MHz as shown in FIG. 3, this compensates for the disadvantage of the high reflection.

Figure 4:
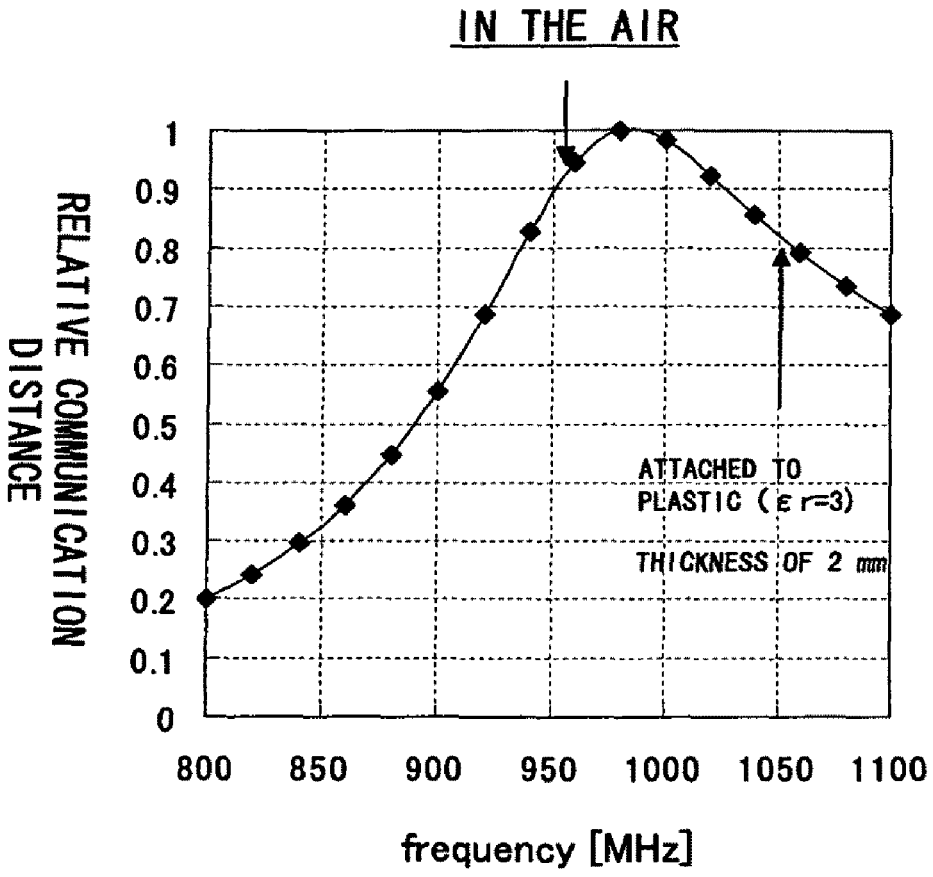
FIG. 4 is a chart representing a communication distance characteristic obtained by combining the reflection characteristic and the gain characteristic of the tag antenna in the first preferred embodiment on Microsoft Excel.

FIG. 4 is a chart representing a communication distance characteristic obtained by combining the above described reflection characteristic and gain characteristic of the dipole antenna 2 of the tag 1 on Microsoft Excel.

In this figure, the horizontal axis indicates the frequency (800 to 1100 MHz), whereas the vertical axis indicates a communication distance relative to the maximum distance as a reference.

As described above, the communication distance characteristic of the dipole antenna 2 of the tag 1 is asymmetrical with respect to the operational frequency 953 MHz of the reader/writer. The communication distance characteristic moderately changes on the side of frequencies higher than the operational frequency 953 MHz of the reader/writer, and is relatively stable.

The calculations by the above electromagnetic field simulator are made by assuming that the air exists above and below the resinous protection films 8 shown in FIG. 1. Therefore, the communication distance at the operational frequency 953 MHz of the reader/writer is a distance in a case where the tag 1, namely, the dipole antenna 2 is in the air.

The communication distance in the air is a distance obtained by multiplying the specified maximum distance shown in FIG. 4 by 0.95. Namely, 95 percent of the maximum distance is secured.

When this tag 1 is attached, for example, to plastic with $\epsilon r$ of 3 and a thickness of 2 mm, an effective permittivity in the periphery of the antenna increases, and a band is shifted by approximately 10 percent. Namely, the waveform shown in FIG. 4 is shifted to the side of the low frequencies approximately by 100 MHz.

In other words, the value of the relative communication distance at the frequency 1050 MHz that is higher than 953 MHz by approximately 10 percent in the waveform of FIG. 4 is a communication distance when the tag 1 is attached to the plastic with the thickness of 2 mm.

A ratio of the communication distance at this time to the maximum distance shown in FIG. 4 is 0.8, that is, 80 percent of the maximum distance is secured.

As is proved also from FIG. 4, the tag 1 in this preferred embodiment can secure the distance of up to 80 percent or more of the maximum communication distance and has an extremely high distance stability even in the air or even if it is attached to foamed polystyrene or 2-mm-thick plastic.

The tag 1 in this preferred embodiment is characterized in that the antenna pattern composed of the dipole parts and the inductance part is adjusted to become as close to the optimum value of the antenna as possible in the vicinity of the operational frequency 953 MHz of the reader/writer.

At frequencies higher than 953 MHz, an increase in the gain of the antenna prevents the communication distance characteristic from being degraded although the reflection goes away from the optimum value of the antenna and becomes higher.

To improve the antenna gain at the frequencies higher than 953 MHz, the total length of the antenna is made closer to one half of the resonance wavelength of the antenna, which achieves high gain efficiency.

The antenna pattern of the dipole antenna 2 of the tag 1 in this preferred embodiment is characterized in that the total length of the antenna when all the bending parts 7 are linearly stretched is made slightly shorter than one half of the resonance wavelength $\lambda$ of the antenna.

In the embodiment shown in FIG. 1, the total length of the antenna when all the bending parts 7 are linearly stretched is approximately 120 mm, and one half of the resonance wavelength $\lambda$ of the antenna is approximately 130 to 140 mm. The tolerable margin 10 mm of the resonance wavelength $\lambda$ of the antenna is set in consideration of the resinous protection films 8 overlaid on the top and the bottom surfaces.

Additionally, the dipole parts 6 are bent inwardly from the end in order to make the units as linear as possible. Moreover, it is preferable to form the inductance unit 4 between the dipole units 6 and 6, since it is desirable not to make the dipole units 6 and 6 close.

With this configuration, impedance at 953 MHz is set to a value close to the optimum value of the antenna, and the gain of the antenna becomes largest in the vicinity of 1050 MHz.

In this way, the tag 1 having an extremely high distance stability, which can secure the distance of up to 80 percent or more of the maximum communication distance, can be secured even in the air, or even if the tag is attached to foamed polystyrene or 2-mm-thick plastic.

In the tag 1 with the dimensions of 53 mm wide by 7 mm deep in this embodiment, the four bending parts 7 are formed in each of the dipole units 6 and 6 as shown in FIG. 1. To reduce the dimensions of the antenna, the number of bending parts 7 in each of the dipole units 6 and 6 may be increased to five, six, or a larger number.

Second Preferred Embodiment

The above described tag 1 is a tag that outputs a linear polarized wave. In the second preferred embodiment, the above described tag 1 that outputs a linear polarized wave is used unchanged without providing a special circuit, etc., and a tag that generates a circular polarized wave and extends its communication distance with a reader/writer is implemented.

Figure 5:
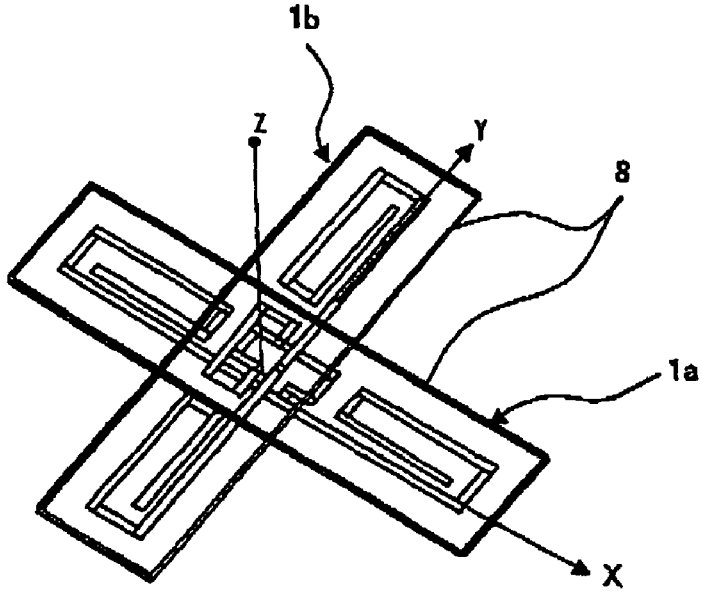
FIG. 5 is a perspective view showing the configuration of a crossed dual tag in a second preferred embodiment, and a top view showing the configuration shown in the perspective view, from which a resinous protection film is removed.
Figure 5:
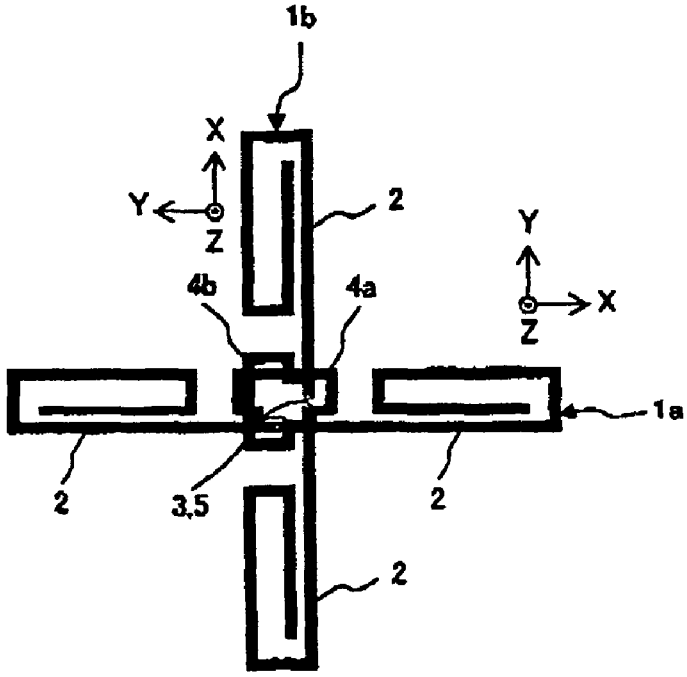

An upper portion of FIG. 5 is a perspective view showing the configuration of the tag that generates the circular polarized wave in the second preferred embodiment, whereas a lower portion of FIG. 5 is a top view showing the configuration shown in the upper portion of FIG. 5, from which the resinous protection film is removed.

For the tag 1 shown in FIG. 1 in the first preferred embodiment, right and left portions (plus X and minus X directions)

of its longer side are symmetrical with respect to the center, but upper and lower portions (plus Y and minus Y directions) of its shorter side are not symmetrical with respect to the center.

The crossed dual tag 10 shown in FIG. 5 is configured by crossing at right angles two tags 1 (1*a*, 1*b*) similar to that shown in FIG. 1, and by stacking them. The configuration of the tags 1*a* and 1*b* is the same as that described in FIG. 1.

In the lower portion of FIG. 5, arrows nearby the tag 1*a*, which are assigned with X, Y, and Z, indicate their corresponding directions, and designate the orientation of the tag 1*a*. Arrows nearby the tag 1*b* designate the orientation of the tag 1*b* in a similar manner.

In this embodiment, the tag the plus Y direction of which is orientated in the plus X direction of the other tag is referred to as the first tag 1*a*, whereas the tag the plus Y direction is orientated in the minus X direction of the other tag is referred to as the second tag 1*b*.

Namely, the crossed dual tag 10 in this embodiment is composed of the first and the second tags 1*a* and 1*b*, which are crossed at the angle of 90° so that the loops of the inductance parts 4 (4*a*, 4*b*) overlap as wide as possible. Additionally, the first and the second tags 1*a* and 1*b* are stacked to contact as closely as possible in their overlapping portion.

Figure 6:
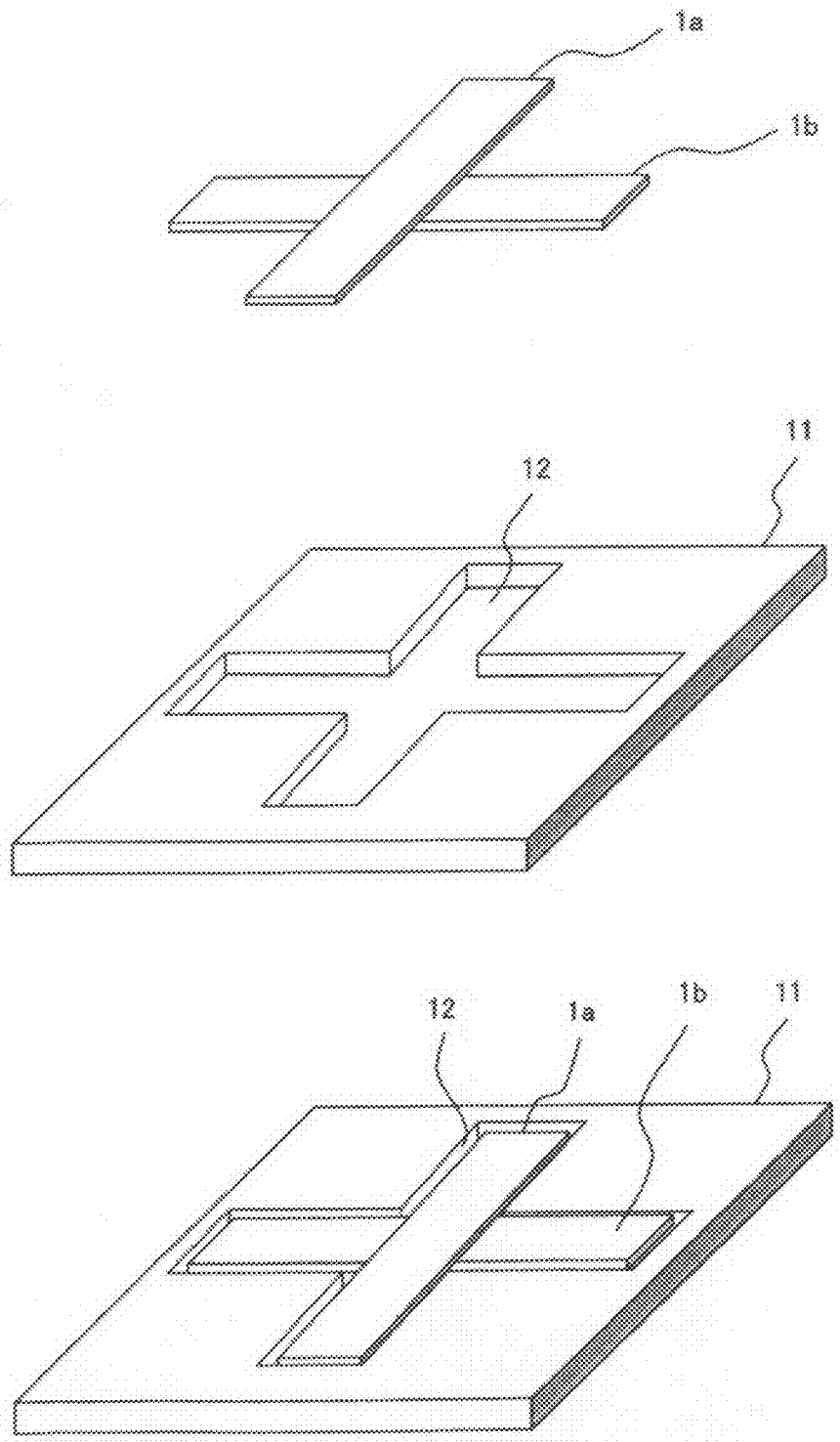
FIG. 6 is a schematic diagram showing a state where crossed and stacked first and second tags of the crossed dual tag in the second preferred embodiment are held in a holder.

In FIG. 6, the upper portion schematically represents the first and the second tags 1*a* and 1*b* stacked in the shape of a cross, the middle portion represents a holder made of, for example, resin, etc., and the lower portion shows the first and the second tags 1*a* and 1*b* held by the holder 11.

In the holder 11, a cross-shaped groove 12 is formed as shown in the middle portion of FIG. 6. The first and the second tags 1*a* and 1*b* are inserted in the cross-shaped groove 12, and pressed and secured from above with a suitable member not shown.

The configuration of the crossed dual tag 10 implemented by crossing and stacking the first and the second tags 1*a* and 1*b* is not limited to the configuration held by the holder 11 where the cross-shaped groove 12 is formed. For example, the first and the second tags 1*a* and 1*b* may be sealed between two resinous sheets.

Figure 7:
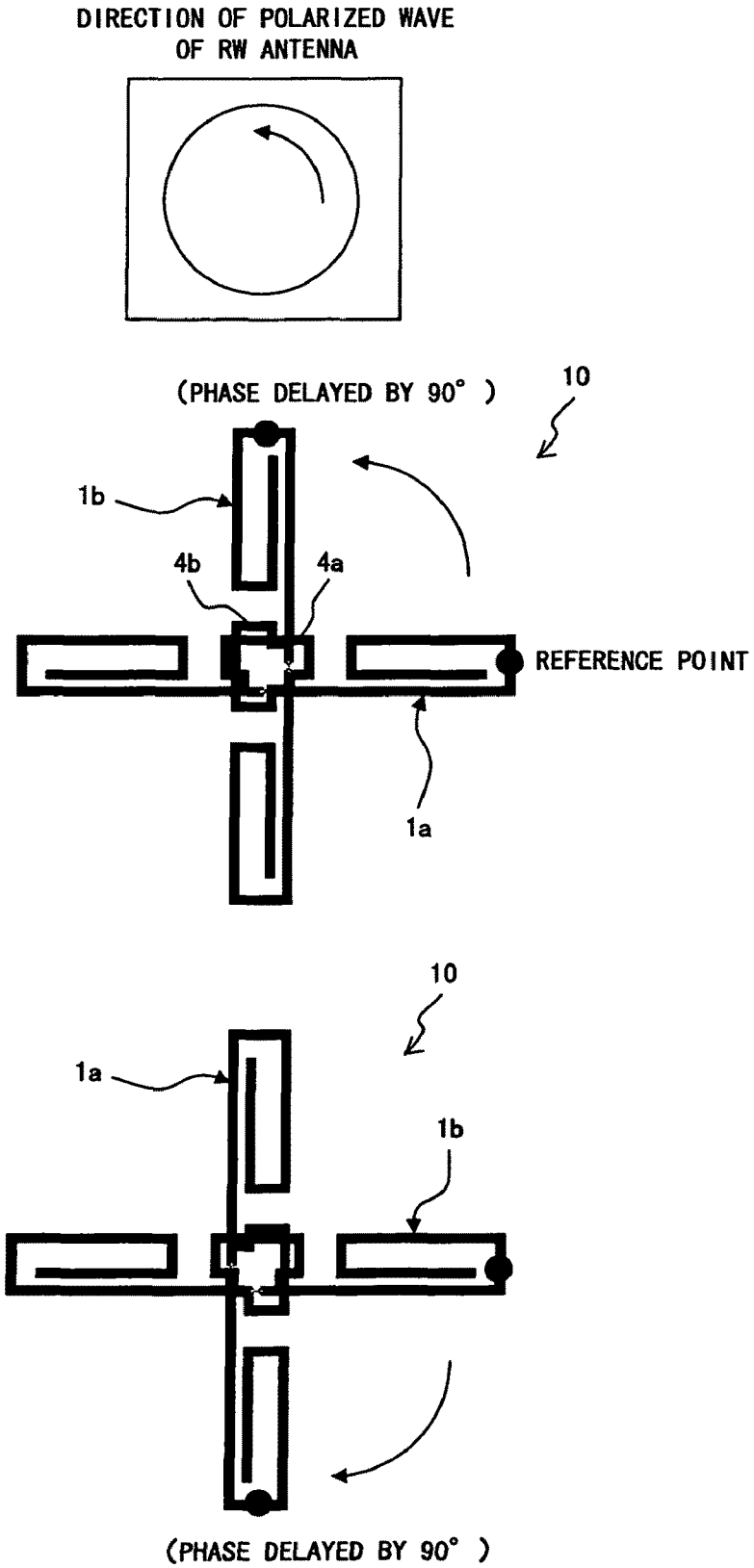
FIG. 7 is schematic diagrams for explaining the operations of the crossed dual tag in the second preferred embodiment, which are performed for a reader/writer (RW)

In FIG. 7, the upper portion is a schematic diagram representing the direction of the polarized wave of the antenna of the reader/writer (R/W), the middle portion is a schematic diagram for explaining the operations of the crossed dual tag 10 performed when the polarized wave surface of the first tag 1*a* is orientated in the direction of the reader/writer, and the lower portion is a schematic diagram for explaining the operations of the crossed dual tag 10 performed when the polarized wave surface of the second tag 1*b* is orientated in the direction of the reader/writer.

If the polarized wave surface of the first tag 1*a* is orientated in the direction of the reader/writer as shown in the middle portion of FIG. 7, the first tag 1*a* operates.

When the first tag 1*a* initially operates as described above, a current flows into the loop of the inductance unit 4*a* of the first tag 1*a*. As a result, high-frequency coupling is made between the loop of the inductance unit 41 of the first tag 1*a* and that of the inductance unit 4*b* of the second tag 1*b*. Consequently, the second tag 1*b* operates with its phase delayed by 90° as will be described later.

If the polarized wave surface of the second tag 1*b* is orientated in the direction of the reader/writer as shown in the lower portion of FIG. 7, the second tag 1*b* operates.

When the second tag 1*b* initially operates as described above, a current flows into the loop of the inductance unit 4*b* of the second tag 1*b*. As a result, high-frequency coupling is made between the loop of the inductance unit 4*b* of the second tag 1*b* and that of the inductance unit 4*a* of the first tag 1*a*. Consequently, the first tag 1*b* operates with its phase delayed by 90°.

Figure 8:
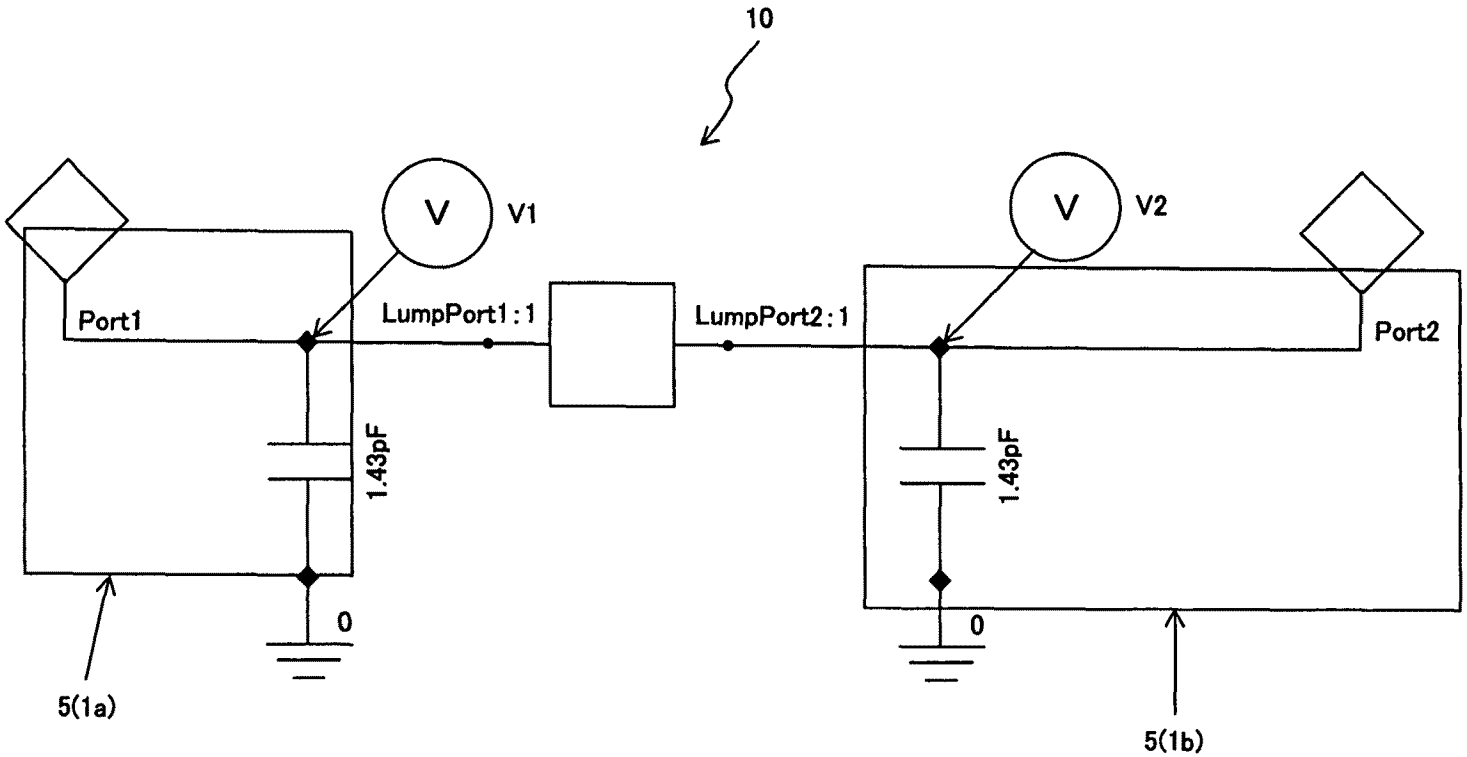
FIG. 8 is a schematic diagram showing a calculation model for calculating the operations of the crossed dual tag in the second preferred embodiment with an electromagnetic field simulator.

FIG. 8 is a schematic diagram showing a calculation model for calculating the operations of the above described crossed dual tag 10 with an electromagnetic field simulator.

Both the IC chips 5 and 5 of the first and the second tags 1*a* and 1*b* respectively have a capacitive component Ccp of 1.43 pF. Additionally, the IC chips 5 and 5 respectively have an internal impedance Rcp of 420Ω.

Figure 9:
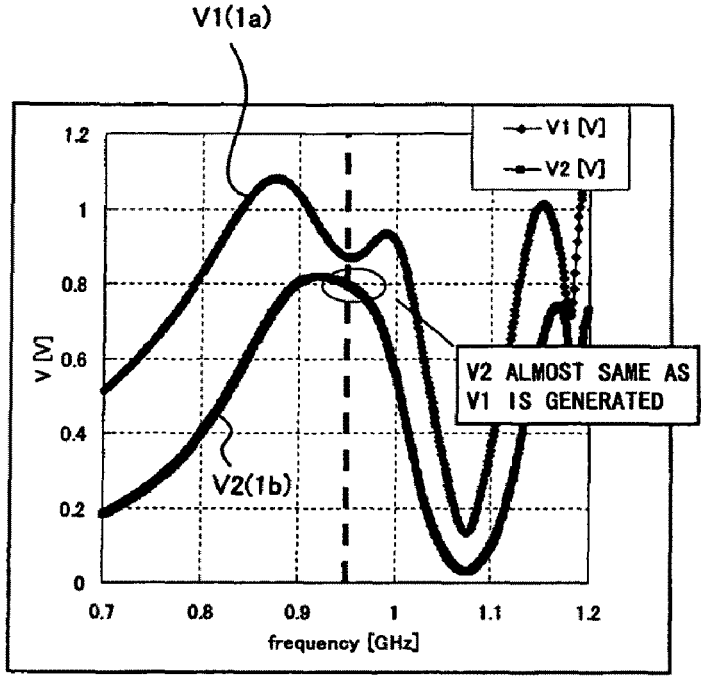
FIG. 9 is a chart representing a relationship between the voltages and the cycles of the crossed dual tag in the second preferred embodiment, which are calculated with the electromagnetic field simulator, and a chart representing a relationship between the cycles and the phases of the crossed dual tag.
Figure 9:
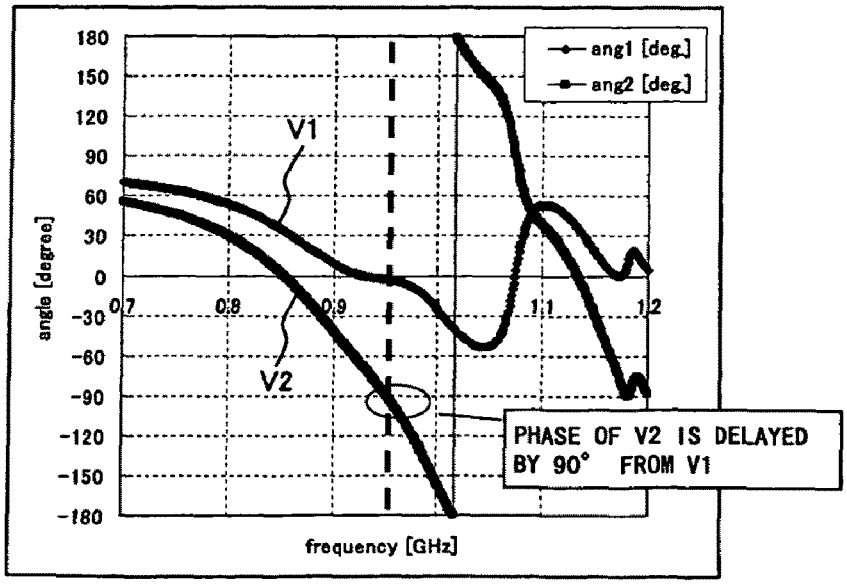

FIG. 9 is charts representing results of the calculation made by the electromagnetic field simulator. The upper chart of FIG. 9 represents the relationship between voltages respectively generated in the IC chips 5 and 5 of the first and the second tags 1*a* and 1*b* and their cycles, and the lower chart of FIG. 9 represents the relationship between the cycles and the phases of the voltages respectively generated in the IC chips 5 and 5.

In the upper chart of FIG. 9, the horizontal axis indicates the cycles of the voltages from 0.7 to 1.2 GHz, whereas the vertical axis indicates the voltages from 0 to 1.2V.

In the cycle at the frequency of 0.953 GHz, a voltage V1 is generated in the IC chip of the tag 1*a*, and a voltage V2 almost the same as the voltage V1 (0.88V) is generated in the IC chip of the tag 1*b* as shown in the upper chart of FIG. 9.

In the lower chart of FIG. 9, the horizontal axis indicates the cycles of the voltages from 0.7 to 1.2 GHz, whereas the vertical axis indicates the phases of the cycles from minus 180° to plus 180°.

It is proved from the relationship between the cycles and the phases shown in the lower chart of FIG. 9 that the phase of the voltage V2 of the tag 1*b* is delayed by 90° from that of the voltage V1 of the tag 1*a* at the cycle of 0.953 GHz that generates the voltage V2 almost the same as the voltage V1 of the tag 1*a* as shown in the upper chart.

Namely, the voltage of 0.8V is generated in the tag 1*b* compared with the voltage of 0.88V generated for the tag 1*a* at the operational frequency of 953 MHz, and the phase of the tag 1*b* is delayed from that of the tag 1*a* as shown in FIG. 9.

That is, the above described operation performed with the phase delayed by 90° is repeated at the cycle of 0.953 GHz. Therefore, operations close to those of a circular polarized wave are proved to be performed when the tags 1*a* and 1*b* are regarded as one pair.

Ideally, however, it is preferable that operations closer to those of the circular polarized wave are performed by generating the same voltages in both the tags 1*a* and 1*b*, and by shifting their phases by 90°.

Additionally, if the direction of the circular polarized wave of the reader/writer (the counterclockwise direction in the upper portion of FIG. 7) matches the rotational direction of the crossed dual tag 10 as shown in the middle portion of FIG. 7 at this time, their communication distance is increased.

Namely, information possessed by the tag 1*a* can be read also in a distance increased by √2, namely, 1.41 times the maximum communication distance between the reader/writer generating the circular polarized wave and the tag generating the linear polarized wave.

In contrast, the tag 1*a* operates with its phase delayed by 90° as shown in the lower portion of FIG. 7 when the tag 1*b* initially operates, the direction of the operation of the above circular polarized wave is reverse to the rotational direction of the circular polarized wave of the reader/writer. Accordingly, the communication distance of the tag 1*b* becomes shorter inversely to the case of the tag 1*a*.

However, if the reader/writer is configured to be able to switch the rotational direction of the circular polarized wave between forward and backward directions at predetermined cycles, both of the tags 1*a* and 1*b* can make a communication in the distance increased by 1.41 times the distance in the case of the single tag.

Figure 10:
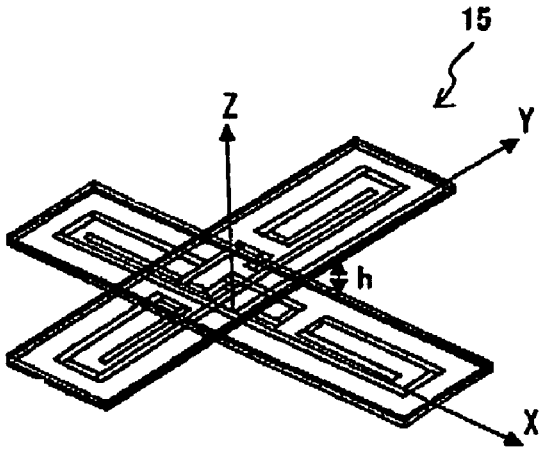
FIG. 10 is charts representing results of an experiment, which are calculated by the electromagnetic field simulator when the first and the second tags do not make close contact in their crossed portions and a gap of a distance h of 1 mm is provided.
Figure 10:
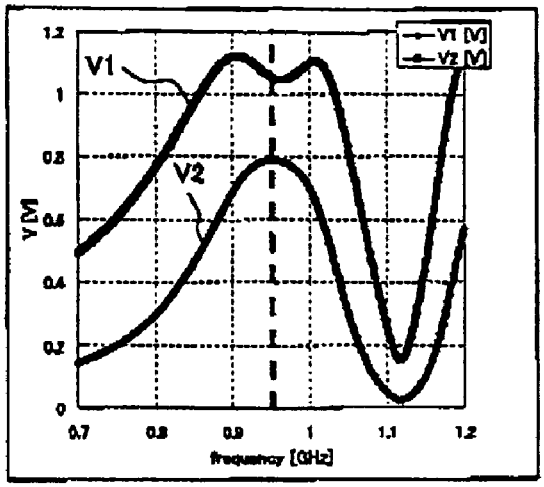
Figure 10:
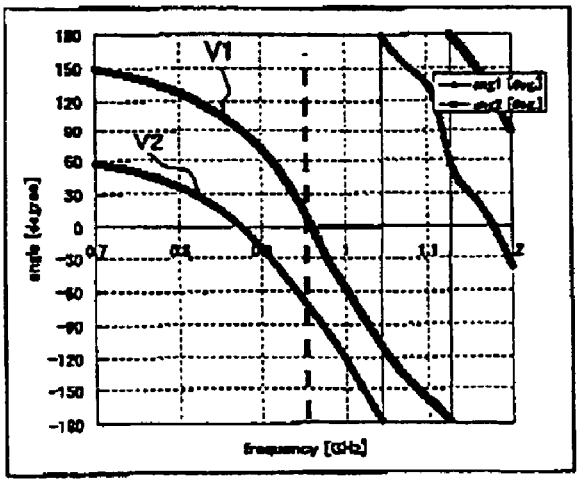

FIG. 10 is charts representing results of the calculations made by the electromagnetic field simulator when the tags 1*a* and 1*b* do not make close contact each other in their overlapping portion (crossed portion), and have a gap of a distance h of 1 mm.

The upper portion of FIG. 10 is a schematic diagram showing a crossed dual tag 15 implemented by crossing the tags 1*a* and 1*b* with the gap of the distance h of 1 mm, the middle portion of FIG. 10 is a chart representing the relationship between voltages respectively generated in the tags 1*a* and 1*b* and their cycles, and the lower portion of FIG. 10 is a chart representing the relationship between the cycles and the phases of the voltages respectively generated in the tags 1*a* and 1*b*.

Making a comparison between the chart in the middle portion of FIG. 10 and that in the upper portion of FIG. 9, the voltage V2 generated in the tag 1*b* is slightly reduced with respect to the voltage V1 generated in the tag 1*a*.

Also making a comparison between the charts in the lower portions of FIGS. 9 and 10, the phase difference between the voltage V1 generated in the tag 1*a* and the voltage V2 generated in the tag 1*b* is proved to be 75°. Namely, the circular polarized wave is slightly deformed.

According to the above results, it is preferable to make the tags 1*a* and 1*b* contact as closely as possible in the crossed portion so as to generate a circular polarized wave in the crossed dual tag.

It is also proved that an elliptical polarized wave is generated when the tags are crossed not in close contact but with a predetermined gap.

Figure 11:
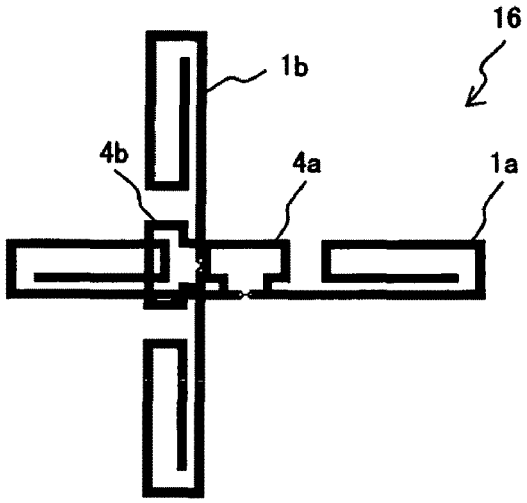
FIG. 11 is charts representing results of an experiment, which are calculated by the electromagnetic field simulator when the first and the second tags are crossed not to make the loops of their inductance parts overlap at all.
Figure 11:
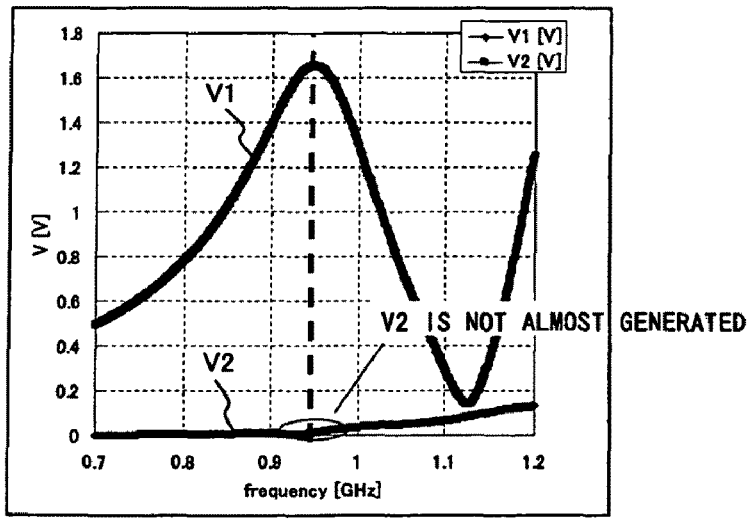
Figure 11:
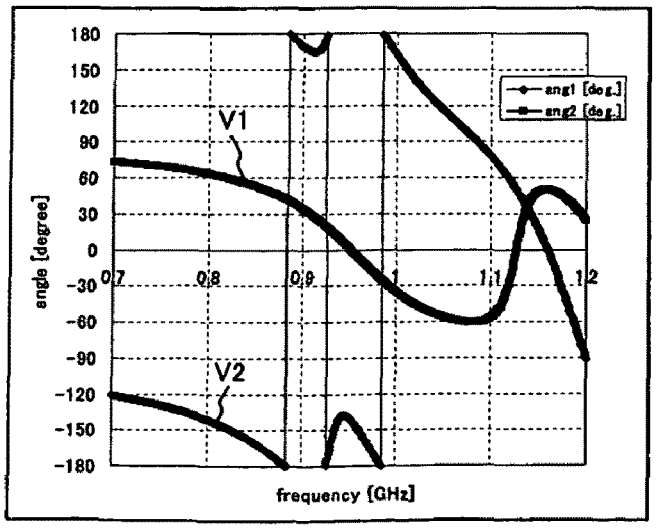

FIG. 11 is charts representing results of calculations made by the electromagnetic field simulator when the loops of the inductance parts 4*a* and 4*b* of the tags 1*a* and 1*b* are made not to overlap at all.

A schematic diagram in the upper portion of FIG. 11 shows a crossed dual tag 17 implemented by crossing the tags 1*a* and 1*b* by causing the loops of the inductance parts not to overlap at all. A chart in the middle portion of FIG. 11 shows the relationship between voltages respectively generated in the tags 1*a* and 1*b* and their cycles. A chart in the lower portion of FIG. 11 shows the relationship between the cycles and the phases of the voltages respectively generated in the tags 1*a* and 1*b*.

It is proved from the chart in the middle portion of FIG. 11 that the voltage V2 of the tag 1*b* is not almost generated compared to the voltage V1 generated in the tag 1*a*, namely, resonant coupling is not made between the tags.

Therefore, it is preferable to make the loops of the inductance units of the tags 1*a* and 1*b* overlap as wide as possible. Accordingly, it is preferable that the loops of the inductance units take the shape of a square, a circle or their similar shapes.

The above described preferred embodiments refer to the RFID system in the UHF band. However, the present invention is applicable also to RFID system of 2.45 GHz as a matter of course.

Additionally, the above described preferred embodiments refer to the cases where the side of the reader/writer generates a circular polarized wave. However, if the side of the reader/writer generates an elliptical polarized wave between the linear and the circular polarized waves, the side of the crossed dual tag may be operated with the elliptical polarized wave by crossing and stacking the two tags not at the angle of 90° but at the angle of, for example, 60°.

Alternatively, the crossed dual tag can be operated with the elliptical polarized wave by displacing the loops of the inductance parts each other.

It is preferable that the loops of the inductance parts take the shape of a square, a circle, or their similar shapes as described above. However, if the loops take the shape of a rectangle, the tags can perform operations sufficiently close to those with the circular polarized wave. Therefore, the crossed dual tag and the RFID system using the crossed dual tag are also applicable to two tags as a matter of course as far as the tags respectively have loops.

Third Preferred Embodiment

An environment for actually using the crossed dual tag is described here.

When tags are mass-produced, different IDs are respectively written to the tags in normal cases. Accordingly, with the crossed dual tag configured according to the present invention, the reader/writer reads the two IDs of the tags 1*a* and 1*b* when making a communication with the crossed dual tag in a short distance.

Accordingly, it is preferable to make the reader/writer read information of only the tag 1*a* by designating the tag 1*b* as a dummy, and by pre-specifying the ID of the tag 1*b* as "kill" within the reader/writer when the tag 1*a* is assumed to be the tag desired to be read by the side of the reader/writer.

This is based on the assumption that different IDs are respectively written to all tags at the factory shipment. However, there are tag types provided with a user memory where information is freely writable to an area within an IC chip.

In such a case, writing the same information to both of user areas of the tags 1*a* and 1*b* prevents a problem from occurring even when the reader/writer reads the tag 1*b* in a short distance.

Additionally, the circular polarized wave surface of the reader/writer is switched in the reverse direction, whereby the communication distance of the tag 1*b* can be extended, and that of the tag 1*a* can be shortened as is evident from FIG. 7.

As described above, the reader/writer can read information of both of the tags 1*a* and 1*b* in the extended communication distance by switching the circular polarized wave surface of the reader/writer between the forward and the backward directions. Namely, it becomes possible to make the reader/writer read different information respectively written to the two user memories, thereby preventing the user memories from being wasted.

Conventionally, in order to implement circular polarized waves of the tags, two tags generating linear polarized waves must be crossed, and a complicated circuit such as a 90° phase shifter, etc. must be provided as described above. With the crossed dual tag according to the present invention, however, a communication distance with a reader/writer can be extended only by crossing and stacking existing tags that generate linear polarized waves and respectively have a loop of an inductance part.

What is claimed is:

1. A crossed dual tag apparatus, including first and second tags, each on one plane, each of the first and second tags being substantially planar and comprising:

a dipole antenna which is formed with conductors and includes two dipole units, the two dipole units being arranged in line symmetry;

a feeding part to which an IC chip is connected at a center of the dipole antenna; and a loop-shaped inductance part that is formed so as to surround the feeding part between the two dipole units, and connected to the two dipole units in parallel with respect to the feeding part, wherein the first and the second tags are crossed orthogonally so that loops of the inductance parts overlap, the inductance part of the first tag and the inductance part of the second tag are positioned where the first and the second tags are crossed, and when one of the first and second tags receives a circular polarized radio wave from an antenna of a reader/writer, the one tag operates and a current flows into the loop of the inductance part of the one tag, and another tag which makes high-frequency coupling with the one tag operates with a phase delayed by 90°, thereby generating a circular polarized wave.

2. The crossed dual tag apparatus according to claim 1, wherein the inductance part is formed in a shape of a square, a circle, or a loop similar to the square or the circle.

3. The crossed dual tag apparatus according to claim 1, wherein the first and the second tags are crossed so that loops of the inductance parts overlap as wide as possible, and stacked to contact as closely as possible.

4. The crossed dual tag apparatus according to claim 1, further comprising a holding member having a groove according to a crossed shape of the first and the second tags, wherein the holding member holds the first and the second tags in the crossed shape with the groove of the holding member.

5. The crossed dual tag apparatus according to claim 4, wherein the first and second tags are spaced by a gap of about 1 mm.

6. The crossed dual tag apparatus according to claim 4, wherein the first tag and the second tag are configured to have a maximum gain at about 1050 MHz.

7. The crossed dual tag apparatus according to claim 1, wherein the first and second tags are spaced by a gap of about 1 mm.

8. The crossed dual tag apparatus according to claim 1, wherein the first tag and the second tag are configured to have a maximum gain at about 1050 MHz.

9. A crossed dual tag system, including:

a crossed dual tag apparatus, comprising first and second tags, each on one plane, each of the tags including a dipole antenna which is formed with conductors and includes two dipole units, the two dipole units being arranged in line symmetry, a feeding part to which an IC chip is connected at a center of the dipole antenna, and a loop-shaped inductance part that is formed so as to surround the feeding part between the two dipole units, and connected to the two dipole units in parallel with respect to the feeding part, the first and the second tags being crossed orthogonally so that loops of the inductance parts overlap, and the inductance part of the first tag and the inductance part of the second tag being positioned where the first and the second tags are crossed; and a reader/writer that emits a wireless signal of a first circular polarized wave in order to read information of the first or the second tag, wherein when one of the first and second tags receives the first circular polarized radio wave from an antenna of the reader/writer, the one tag operates and a current flows into the loop of the inductance part of the one tag, and another tag which makes high-frequency coupling with the one tag operates with a phase delayed by 90°, thereby generating a second circular polarized wave.

10. The crossed dual tag system according to claim 9, wherein the first tag is set as a tag from which information is to be read, the second tag is set as a tag from which information is not to be read, and the reader/writer always reads only the information of the first tag.

11. The crossed dual tag system according to claim 9, wherein:

the first and the second tags respectively have user memory areas to which same information is written; and the reader/writer switches a rotational direction of a rotary surface of the circular polarized wave of the wireless signal, and reads the information written to the user memory area from the first or the second tag, which responds more strongly to the circular polarized wave.

12. The crossed dual tag system according to claim 9, wherein:

the first and the second tags respectively have user memory areas to which mutually different information are written; and the reader/writer sequentially switches a rotational direction of a rotary surface of the circular polarized wave of the wireless signal, and reads the information written to the user memory areas from both of the first and the second tags by reading the information written to the user memory area from the first or the second tag, which responds more strongly to the circular polarized wave.

13. The crossed dual tag system according to claim 12, wherein:

the first and second tags are spaced by a gap of about 1 mm.

14. The crossed dual tag system according to claim 13, wherein:

the first tag and the second tag are configured to have a maximum gain at about 1050 MHz.

15. The crossed dual tag system according to claim 9, wherein:

the first and second tags are spaced by a gap of about 1 mm.

16. The crossed dual tag system according to claim 9, wherein:

the first tag and the second tag are configured to have a maximum gain at about 1050 MHz.

17. The crossed dual tag system according to claim 9, wherein:

the crossed dual tag apparatus is to communicate to 80 percent or more of a theoretical maximum communication distance even if the tag is embedded in a foamed polystyrene or 2 mm thick plastic.

* * * * *